US005967037A

United States Patent [19]

Su

[11] Patent Number: 5,967,037

[45] Date of Patent: Oct. 19, 1999

[54] PRINTING MACHINE HAVING A LOWER BOX AND AN UPPER BOX ADJUSTABLY SUPPORTED ON TO THE LOWER BOX

[76] Inventor: Chiung-Fen Su, No. 1, Lane 372, Sec. 1, May-Tsun Rd., Taichung, Taiwan

[21] Appl. No.: 09/061,637

[22] Filed: Apr. 16, 1998

[51] Int. Cl.[6] ..... B41F 13/24

[52] U.S. Cl. ..... 101/247; 101/37; 101/484

[58] Field of Search ..... 101/484, 485, 101/486, 153, 154, 218, 37, 247; 400/56

[56] References Cited

U.S. PATENT DOCUMENTS

| | | | |
|---|---|---|---|
| 482,855 | 9/1892 | Tilton et al. | 101/247 |
| 3,136,242 | 6/1964 | Gemelli | 101/37 |
| 3,867,882 | 2/1975 | Ahlgren et al. | 101/484 |
| 3,877,367 | 4/1975 | Norwood | 101/484 |
| 4,077,317 | 3/1978 | Kiesewetter et al. | 101/37 |
| 5,456,169 | 10/1995 | Rohwetter et al. | 101/484 |

*Primary Examiner*—Edgar Burr
*Assistant Examiner*—Leslie Grohusky
*Attorney, Agent, or Firm*—Brinks Hofer Gilson & Lione

[57] ABSTRACT

A printing machine includes a machine base, a lower box mounted on the machine base, an upper box mounted on the lower box in a vertically movable and adjustable position, a conveyor passing horizontally between the upper and lower boxes, and an upper printing device mounted in the upper box for printing a workpiece carried by the conveyor. The lower box has an adjustable support for adjustably supporting the upper box. The adjustable support has two upright support tubes mounted to the lower box, and driven shafts received rotatably in the support tubes. Each of the driven shafts has an upper end, a lower end which extends outwardly of a respective one of the support tubes, a threaded hole which extends longitudinally in the upper end, and an upright connecting rod with an externally threaded lower end that engages the threaded hole and an upper end connected to the upper box. The lower box further has a driving mechanism to drive the driven shafts. The driving mechanism has a horizontal driving shaft mounted to the lower box, an operating handle wheel mounted on the horizontal driving shaft, and a transmission unit connected to the horizontal driving shaft and the lower ends of the driven shafts.

3 Claims, 7 Drawing Sheets

PRINTING MACHINE HAVING A LOWER BOX AND AN UPPER BOX ADJUSTABLY SUPPORTED ON TO THE LOWER BOX

BACKGROUND OF THE INVENTION

1. Field of the Invention

This invention relates to a printing machine having upper and lower boxes for receiving upper and lower printing devices respectively, more particularly to a printing machine having an upper box which is supported above a lower box thereof and which can be moved easily and locked securely relative to the lower box.

2. Description of the Related Art

Referring to FIGS. 1 and 2, a conventional printing machine is shown to comprise a machine base 1, upper and lower boxes 2, 3 mounted on the machine base 1, right and left boxes 4, 5 mounted on the machine base 1, and a conveyor 9 passing horizontally between the upper and lower boxes 2, 3 and between the right and left boxes 4, 5. The upper and lower boxes 2, 3 have upper and lower printing devices S mounted therein, respectively. The right and left boxes 4, 5 have right and left printing devices 7 mounted therein, respectively. An ink-supplying device 8 is connected to the upper and lower printing devices 6 and the right and left printing devices 7 through connecting pipes 801. With the above structure, three side faces of a U-shaped workpiece 701 carried by the conveyor 9 can be printed respectively by means of the upper and lower printing devices 6 and the right and left printing devices 7 when the U-shaped workpiece 701 passes between the upper and lower boxes 2, 3 and between the right and left boxes 4, 5. The distance between the upper and lower boxes 2, 3, i.e., the distance between either one of the upper and lower printing devices 6 and the conveyor 9 is adjustable by rotating an operating handle wheel 207. The distance between the right and left boxes 4, 5 is adjustable by rotating an operating handle wheel 402.

Referring to FIG. 3, an adjustable support device is employed to support the upper box 2 on the lower box 3 in a vertically movable and adjustable position. The adjustable support device includes two dovetailed tenons 204 formed on two opposite sides of the upper box 2, and two dovetailed grooves 304 formed on two opposite sides of the lower box 3. The tenons 204 are received respectively in the grooves 304 so that the upper box 2 is disposed slidably on the lower box 3. A support block 205 is fixed to the upper box 2. A locking block 305 is fixed to the lower box 3. A threaded shaft 208 extends through a threaded hole 206 in the support block 205 and the locking block 305. The threaded shaft 208 has a diameter-reduced lower end portion 209 engaging a locking pin 306 in the locking block 305 such that the threaded shaft 208 is rotatable but not movable in the axial direction with respect to the locking block 305. When the handle wheel 207, and therefore the threaded shaft 208, is rotated, the upper box 2 can move vertically with respect to the lower box 3, thereby resulting in a desired gap between the upper and lower boxes 2, 3 to permit a workpiece of specified size to pass therebetween.

The adjustable support device suffers from the following disadvantages:

1. Since the adjustable support device has no positioning means to position the upper box 2 relative to the lower box 3 after the upper box 2 is moved to a desired position, the upper box 2 may move downward gradually by virtue of its weight. Thus, the distance between the upper and lower boxes 2, 3 is reduced undesirably. Therefore, the workpiece 701 may be prevented from passing through the upper and lower boxes 2, 3.
2. Since the rotary shaft extends vertically through the upper box 2, and since the handle wheel 207 is located on the top of the upper box 2 at a relatively high position, the operation of the handle wheel 207 is relatively inconvenient to conduct.

SUMMARY OF THE INVENTION

An object of the present invention is to provide a printing machine having an adjustable support that can prevent relative movement of the upper and lower boxes of the printing machine when the upper box is moved away from the lower box at a desired distance.

Another object of the present invention is to provide a printing machine having an operating handle wheel that can be operated conveniently.

According to the present invention, a printing machine comprises a machine base, a lower box mounted on the machine base, an upper box mounted on the lower box in a vertically movable and adjustable position, a conveyor passing horizontally between the upper and lower boxes, and an upper printing device mounted in the upper box and adapted for printing a workpiece carried by the conveyor. The lower box has an adjustable support mounted thereon for adjustably supporting the upper box. The adjustable support includes two upright support tubes mounted to the lower box, and driven shafts received rotatably in the support tubes. Each of the driven shafts has an upper end, a lower end which extends outwardly of a respective one of the support tubes, a threaded hole which extends longitudinally in the upper end, and an upright connecting rod with an externally threaded lower end that engages the threaded hole and an upper end connected to the upper box. The lower box further has a driving mechanism to drive the driven shafts. The driving mechanism has a horizontal driving shaft mounted to the lower box, an operating handle wheel mounted on the horizontal driving shaft, and transmission means connected to the horizontal driving shaft and the lower ends of the driven shafts.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
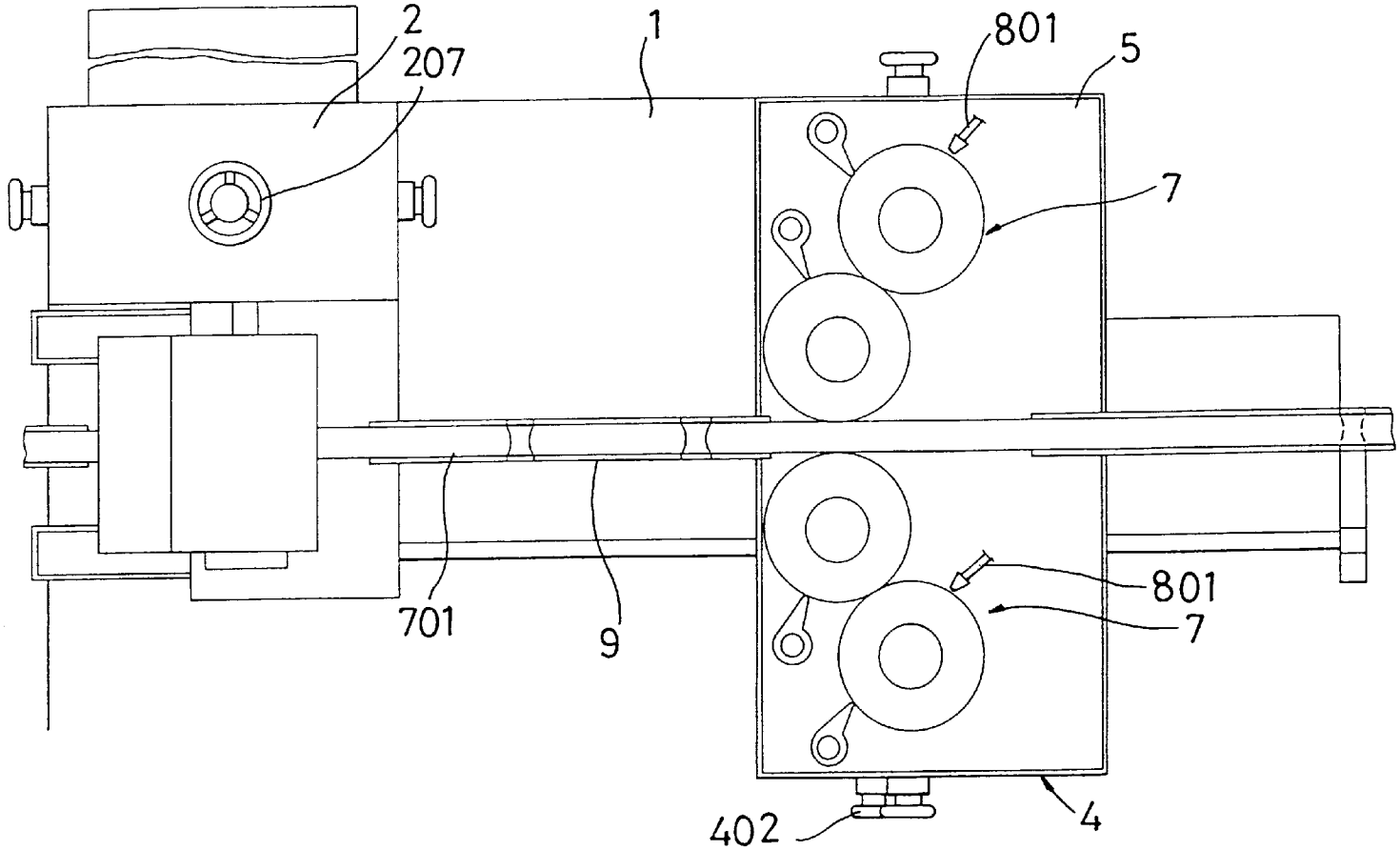
FIG.1 PRIOR ART
FIG. 1 is a top schematic view of a conventional printing machine.
Figure 2:
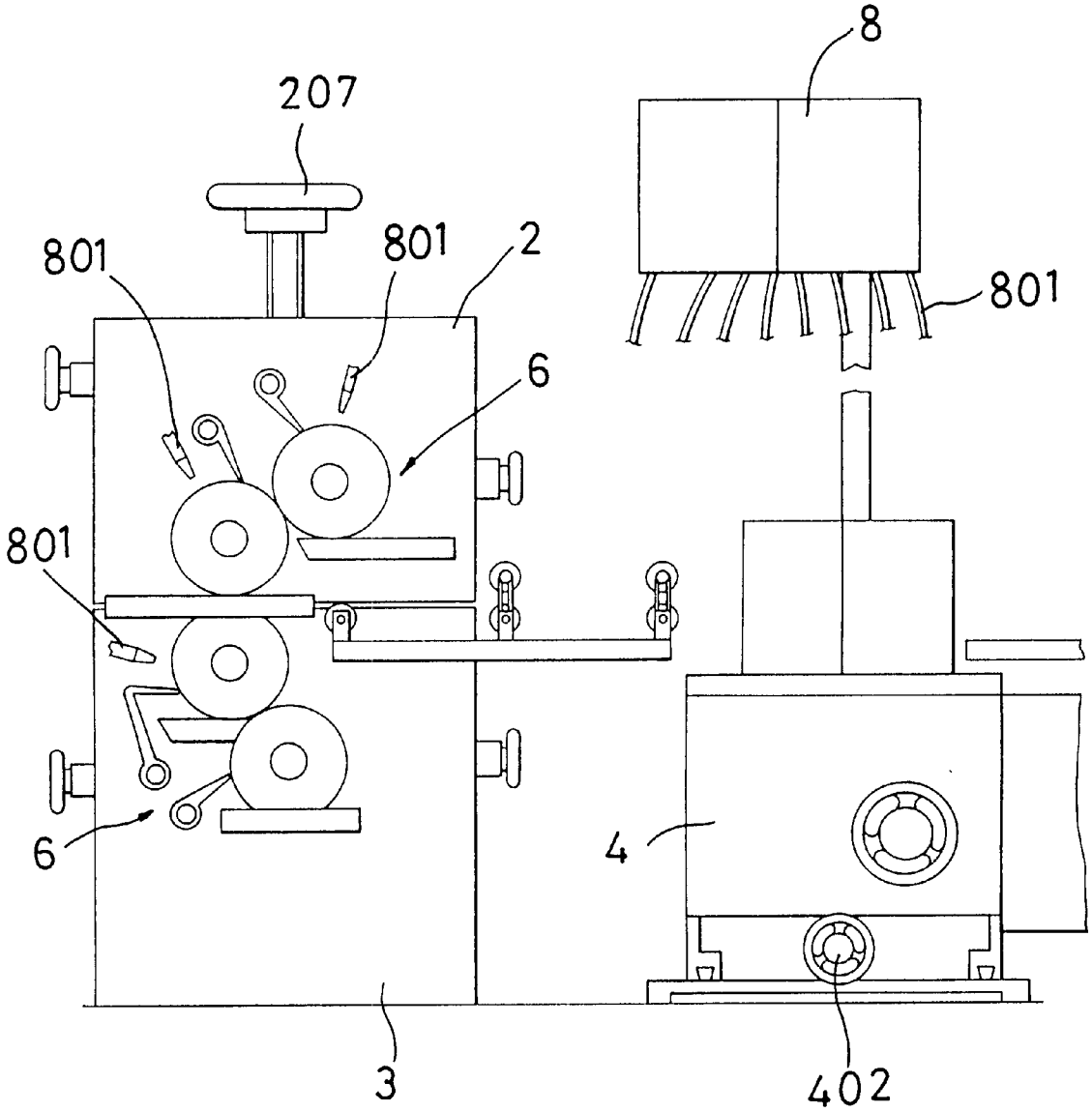
FIG.2 PRIOR ART
FIG. 2 is a side schematic view of the conventional printing machine.
Figure 3:
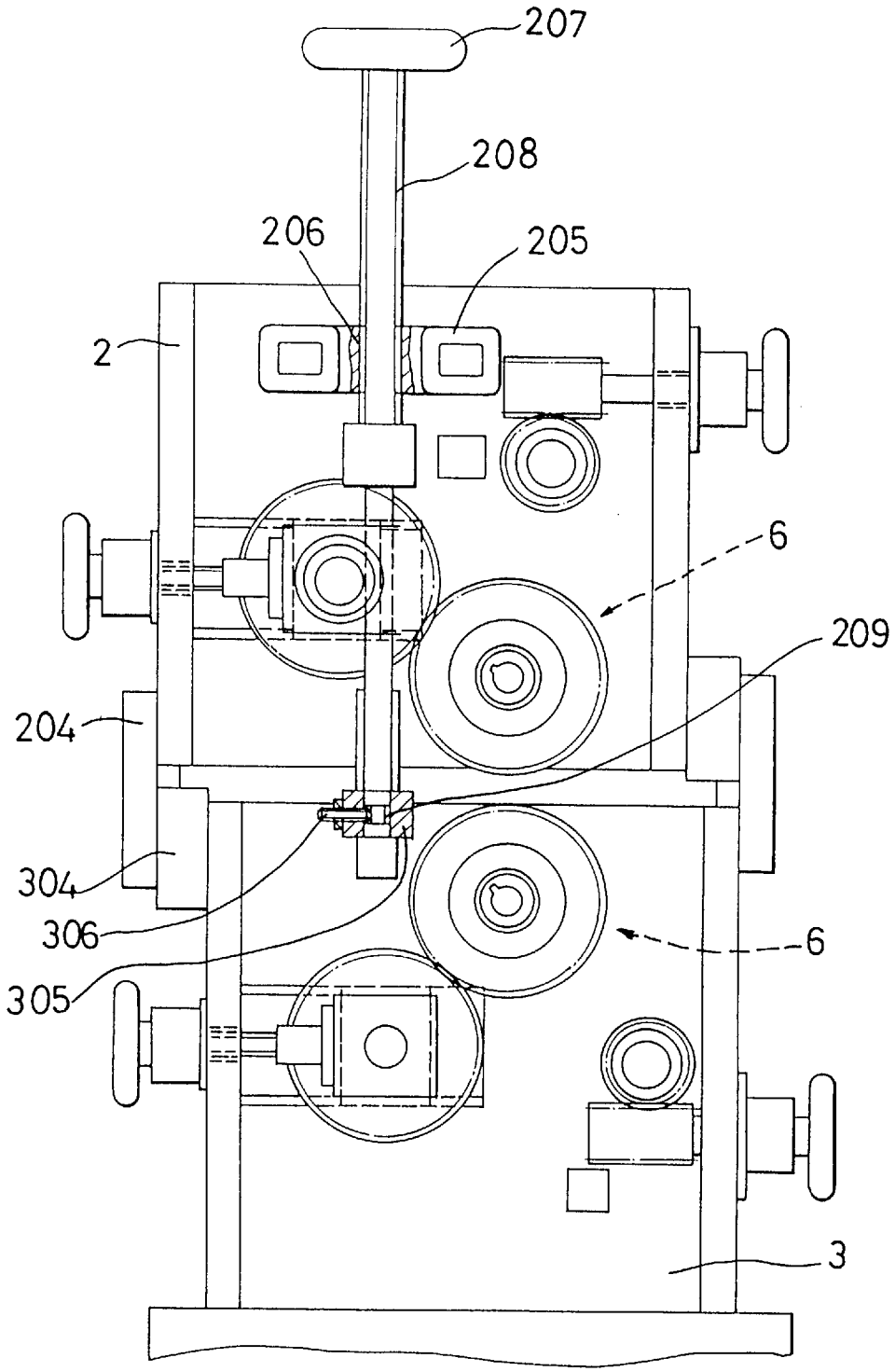
FIG. 3 PRIOR ART
FIG. 3 is a schematic illustrating upper and lower boxes of the conventional printing machine.
Figure 4:
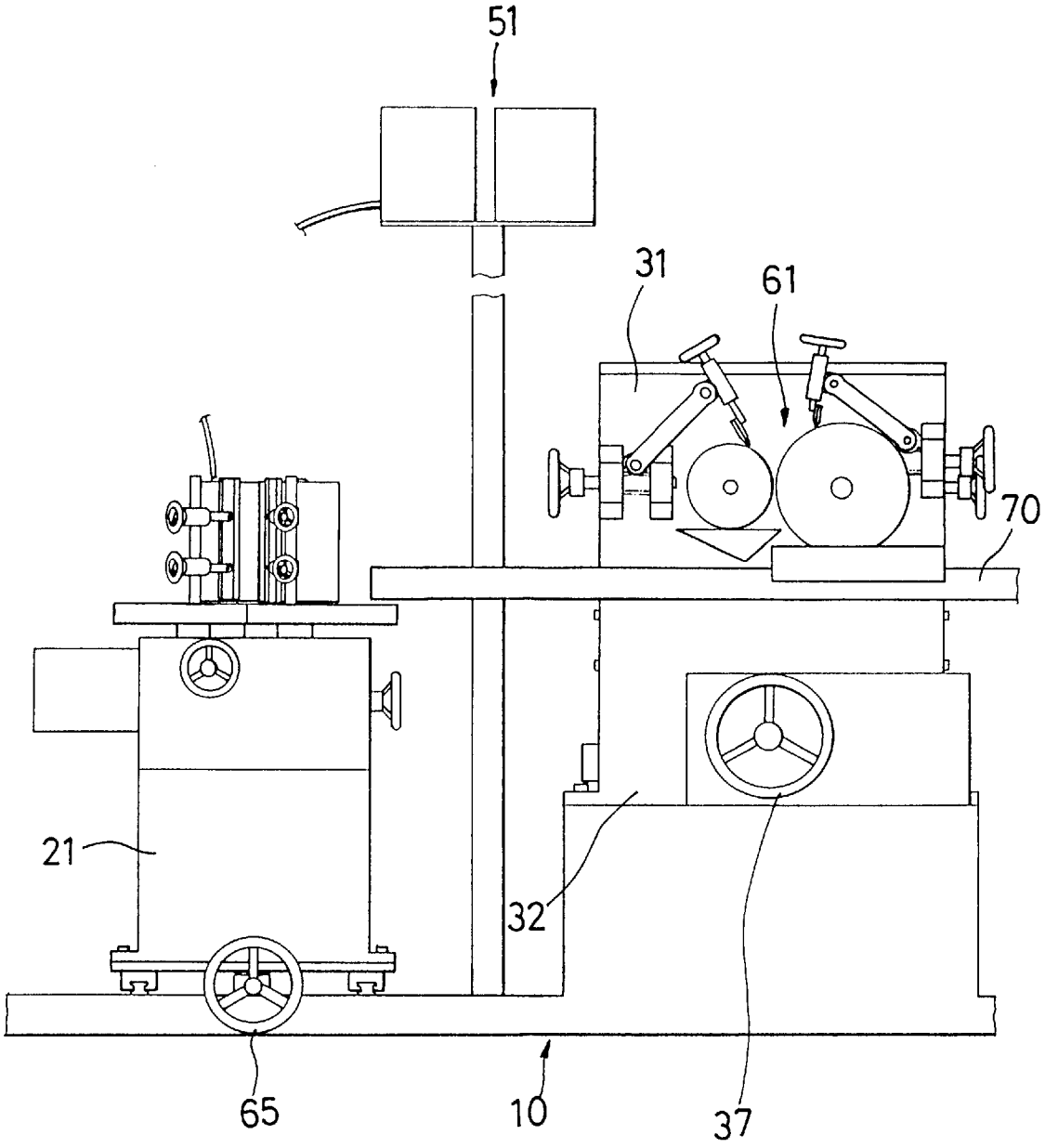
FIG. 4 is a side schematic view of a preferred embodiment of a printing machine according to the present invention.
Figure 5:
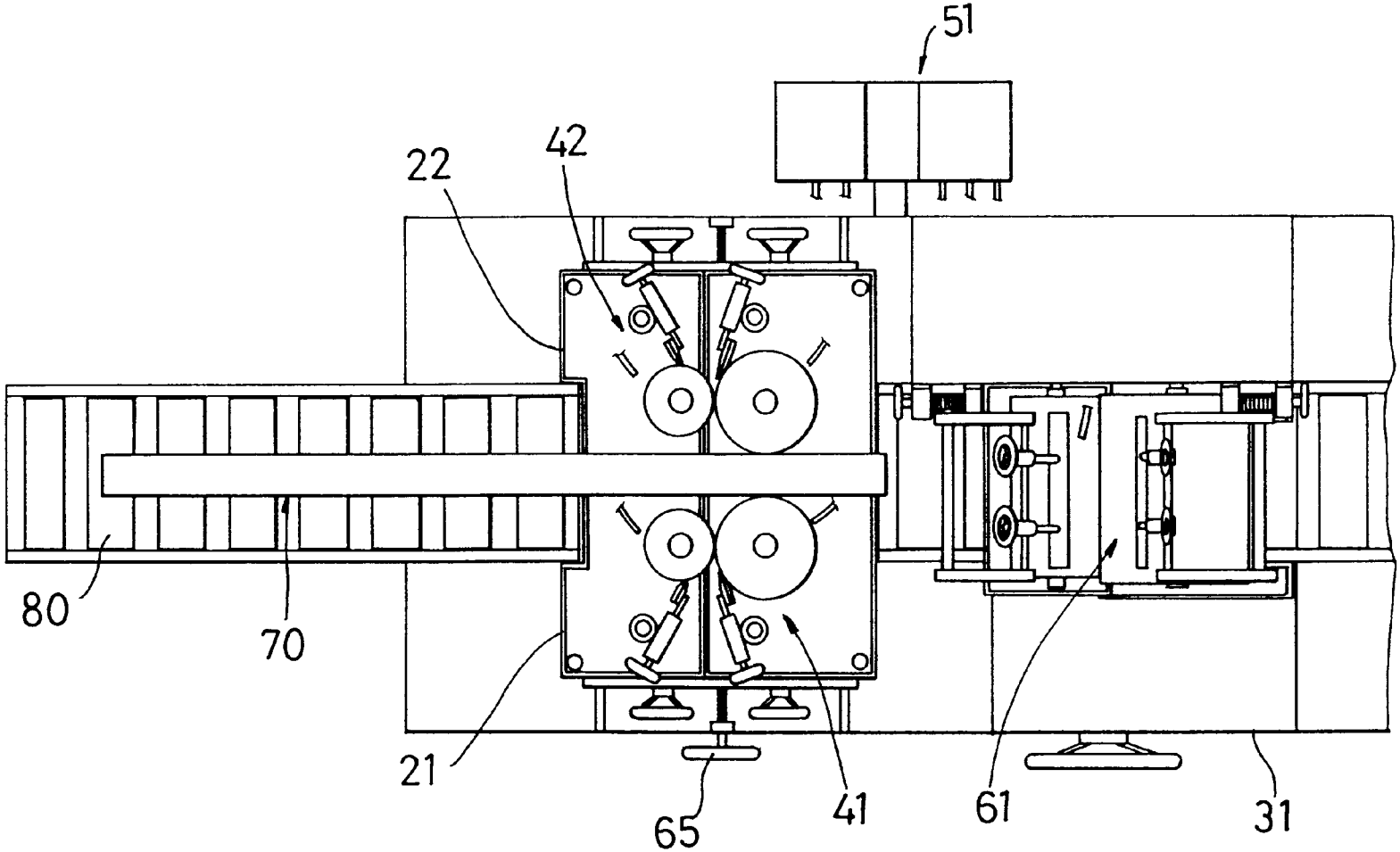
FIG. 5 is a top schematic view of the preferred embodiment of the printing machine of the present invention.
Figure 6:
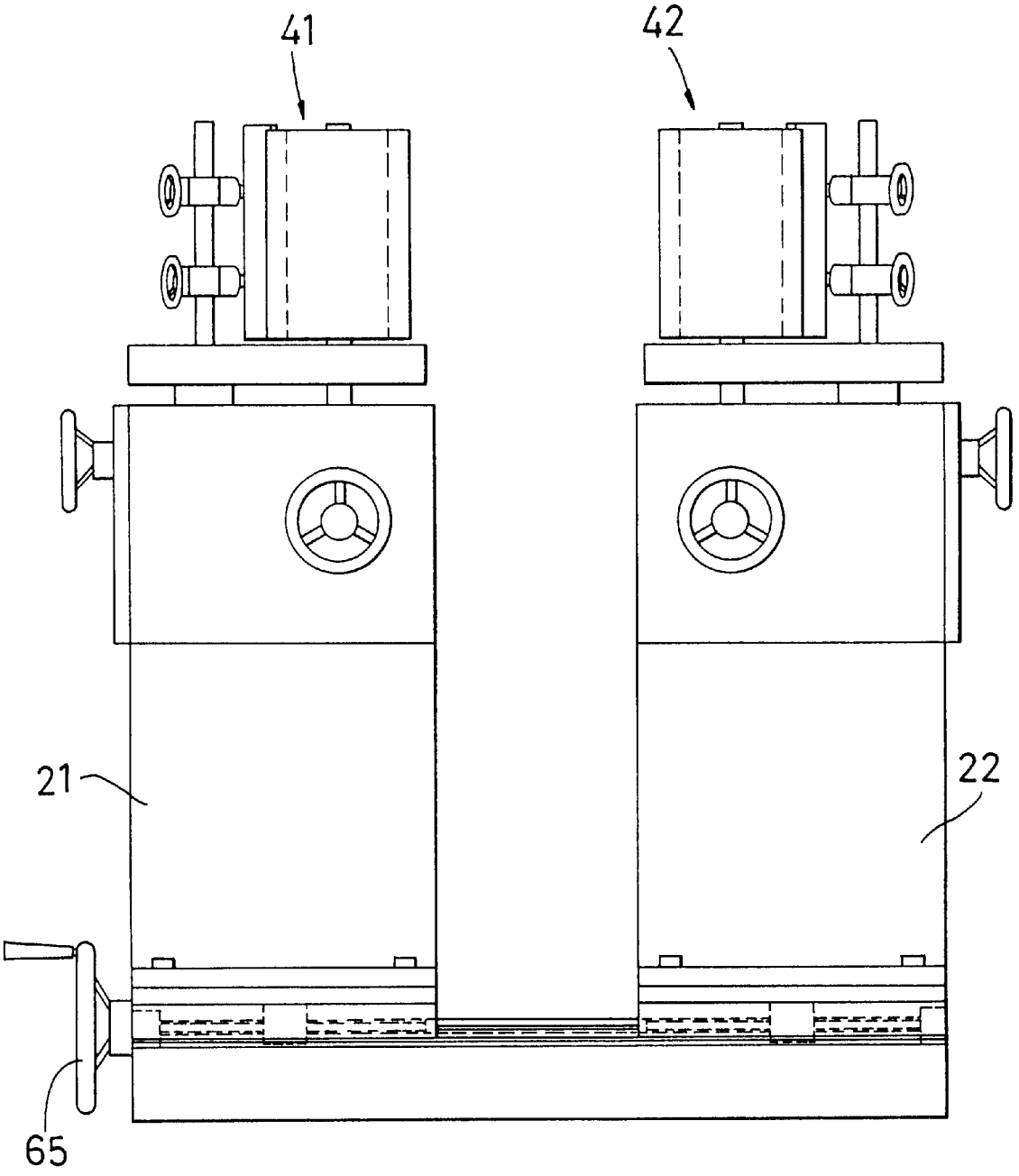
FIG. 6 is a schematic view illustrating the right and left boxes of the preferred embodiment of the printing machine of this invention.

Referring to FIGS. 4 and 5 the preferred embodiment of a printing machine according to the present invention is schematically shown to comprise a machine base 10, a lower box 32 mounted on the machine base 10, an upper box 31 mounted on the lower box 32 in a vertically movable and adjustable position, a conveyor 80 passing between the upper and lower boxes 31, 32, and an upper printing device 61 mounted in the upper box 31 for printing a workpiece 70 carried by the conveyor 80. The machine base 10 further has right and left boxes 21, 22 mounted thereon. The right and left boxes 21, 22 have right and left printing devices 41, 42 mounted respectively thereon. An ink-supplying device 51 is mounted on the machine base 10 in order to supply ink to the upper printing device 61 and the right and left printing devices 41, 42 in a conventional manner. The distance between the right and left boxes 21, 22 is adjustable by rotating a handle wheel 65 in a conventional manner, as best illustrated in FIG. 6.

Figure 7:
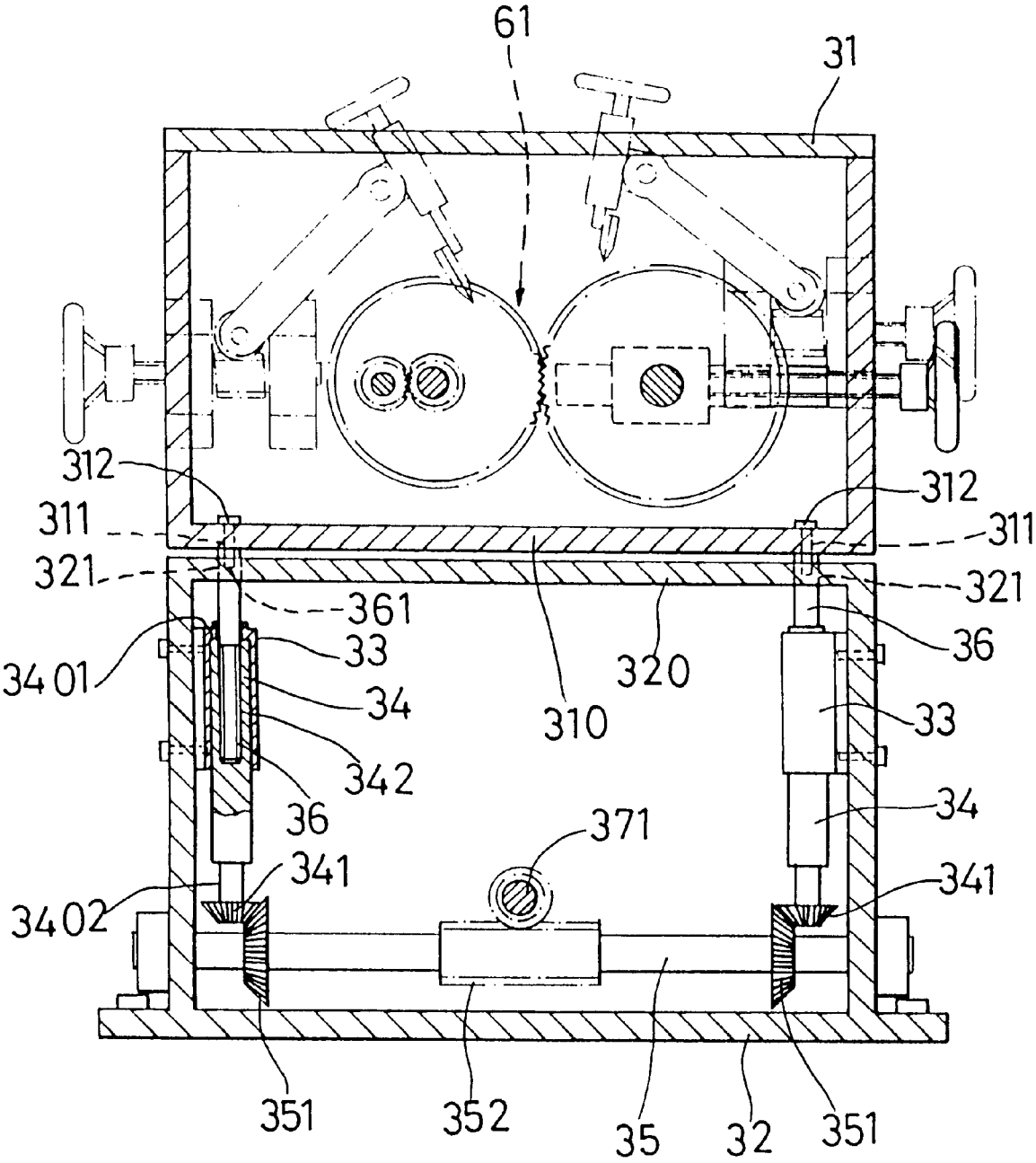
FIG. 7 is a partly sectional schematic view illustrating how the upper and lower boxes of the preferred embodiment of the printing machine of this invention are connected.

Referring to FIG. 7, the lower box 32 has an adjustable support mounted thereon for adjustably supporting the upper box 31. The adjustable support includes two upright support tubes 33 mounted to two opposite internal wall faces of the lower box 32, and driven shafts 34 received rotatably in the through holes 311 that are formed respectively in the support tubes 33. Each of the driven shafts 34 has an upper end 3401, a lower end 3402 which extends outwardly of a respective one of the support tubes 33, a threaded hole 342 which extends longitudinally in the upper end 3401, and an upright connecting rod 36. The connecting rod 36 has an externally threaded lower end that engages the threaded hole 342, and an upper end connected to the upper box 31. The lower box 32 further has a driving mechanism to drive the driven shafts 34. The driving mechanism has a horizontal driving shaft 371 mounted to the lower box 32, an operating handle wheel 37 mounted on the horizontal driving shaft 371, and transmission means connected to the horizontal driving shaft 371 and the lower ends 3402 of the driven shafts 34.

Each of the lower ends 3402 of the driven shafts 34 has a first bevel gear 341 connected thereto. The transmission means has a transmission shaft 35 mounted rotatably and substantially horizontally to the lower box 32. The transmission shaft 35 has two second bevel gears 351 and a worm gear 352 integrally connected to an intermediate portion of the transmission shaft 35. Each of the second bevel gears 351 engages the first bevel gear 341 of a respective one of the driven shafts 34. The horizontal driving shaft 371 is formed as a worm that engages the worm gear 352 of the transmission shaft 35.

The lower box 32 has a top wall 320 and two holes 321 formed in the top wall 320. The upper ends of the connecting rods 36 extend through the holes 312 in the lower box 32. Each of the upper ends of the connecting rods 36 has a threaded hole 361 formed therein. The upper box 31 has a bottom wall 310, two through holes 311 formed in the bottom wall 310, and two bolts 312 which extend through the through holes 311 to engage the threaded holes 361 in the upper ends of the connecting rods 36 in order to secure the upper box 31 to the lower box 32.

To move the upper box 31 vertically relative to the lower box 32, the user can rotate conveniently the handle wheel 37 that is located at a lower position as compared to the aforementioned conventional handle wheel 207. Then, the worm 371 rotates the transmission shaft 35, the second and first bevel gears 351, 341 and the driven shafts 34. Rotation of the driven shafts 34 in the support tubes 33 moves the connecting rods 36 upwardly or downwardly with respect to the driven shafts 34, thereby resulting in upward or downward movement of the upper box 31 with respect to the lower box 32. Therefore, the distance between the upper and lower boxes 31, 32 can be adjusted as desired. Since the worm gear 352 cannot drive the worm 371 to rotate, which can result in undesirable downward movement of the upper box 31 relative to the lower box 32, the distance between the upper and lower boxes 31, 32 can be maintained, unless the handle wheel 37 is driven rotatably by the user. Thus, the objects of the present invention are met.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A printing machine comprising a machine base, a lower box mounted on said machine base, an upper box mounted on said lower box in a vertically movable and adjustable position, a conveyor passing horizontally between said upper and lower boxes, and an upper printing device mounted in said upper box and adapted for printing a workpiece carried by said conveyor, said lower box having an adjustable support mounted thereon for adjustably supporting said upper box, said adjustable support including two upright support tubes mounted to said lower box, and driven shafts received rotatably in said support tubes, each of said driven shafts having an upper end, a lower end which extends outwardly of a respective one of said support tubes, a threaded hole which extends longitudinally in said upper end, and an upright connecting rod with an externally threaded lower end that engages said threaded hole and an upper end connected to said upper box, said lower box further having a driving mechanism to drive said driven shafts, said driving mechanism having a horizontal driving shaft mounted to said lower box, an operating handle wheel mounted on said horizontal driving shaft, and transmission means connected to said horizontal driving shaft and said lower ends of said driven shafts.

2. The printing machine as claimed in claim 1, wherein each of said lower ends of said driven shafts has a first bevel gear connected thereto, said transmission means having a transmission shaft mounted rotatably and substantially horizontally to said lower box, said transmission shaft having two second bevel gears and a worm gear integrally connected to an intermediate portion of said transmission shaft, each of said second bevel gears engaging said first bevel gear of a respective one of said driven shafts, said horizontal driving shaft being formed as a worm that engages said worm gear of said transmission shaft.

3. The printing machine as claimed in claim 2, wherein said lower box has a top wall and two holes formed in said top wall, said upper ends of said connecting rods of said driven shafts extending through said holes in said lower box, each of said upper ends of said connecting rods hating a threaded hole formed therein, said upper box having a bottom wall, two through holes formed in said bottom wall, and two bolts which extend through said through holes to engage said threaded holes in said upper ends of said connecting rods in order to secure said upper box to said lower box.

* * * * *

UNITED STATES PATENT AND TRADEMARK OFFICE

CERTIFICATE OF CORRECTION

PATENT NO. : 5,967,037

DATED : October 19, 1999

INVENTOR(S) : Chiung-Fen Su

It is certified that error appears in the above-identified patent and that said Letters Patent is hereby corrected as shown below:

In Claim 3, line 5, delete "hating" and substitute --having-- in its place.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*